US010266975B2

(12) United States Patent
Kumihiro

(10) Patent No.: US 10,266,975 B2
(45) Date of Patent: Apr. 23, 2019

(54) NONWOVEN AND STRETCHABLE LAMINATE

(71) Applicant: 3M INNOVATIVE PROPERTIES COMPANY, St. Paul, MN (US)

(72) Inventor: Kioshi Kumihiro, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/441,136

(22) PCT Filed: Nov. 8, 2013

(86) PCT No.: PCT/US2013/069087
§ 371 (c)(1),
(2) Date: May 6, 2015

(87) PCT Pub. No.: WO2014/074788
PCT Pub. Date: May 15, 2014

(65) Prior Publication Data

US 2015/0299918 A1 Oct. 22, 2015

(30) Foreign Application Priority Data

Nov. 8, 2012 (JP) ..... 2012-246341

(51) Int. Cl.
*D04H 1/541* (2012.01)
*D04H 1/56* (2006.01)
(Continued)

(52) U.S. Cl.
CPC ..... *D04H 1/541* (2013.01); *D01F 8/06* (2013.01); *D01F 8/16* (2013.01); *D04H 1/56* (2013.01);
(Continued)

(58) Field of Classification Search
CPC ..... Y01T 42/637; Y01T 42/647; D04H 1/541; D10B 2321/021; D10B 2401/061
(Continued)

(56) References Cited

U.S. PATENT DOCUMENTS 5,238,733 A 8/1993 Joseph
5,316,838 A 5/1994 Crandall
(Continued)

FOREIGN PATENT DOCUMENTS

CN 1474886 2/2004
CN 102605556 7/2012
(Continued)

OTHER PUBLICATIONS

Material Safety Data Sheet, Elastollan LP 9062, BASF Polyurethane GmbH, accessed Oct. 20, 2015.*
(Continued)

*Primary Examiner* — Camie S Thompson

(57) ABSTRACT

Nonwovens that have excellent stretchability in both the machine direction and the cross direction, and laminates including such nonwovens. The nonwoven includes fibers having a core-in-sheath structure including a core part and sheath part. The core part includes a thermoplastic elastomer. The sheath part includes a polyolefin having a melt flow rate greater than or equal to 100 g/10 minutes, and a viscosity lower than the thermoplastic elastomer at a specific temperature selected in a temperature range of from 220° C. to 260° C.

16 Claims, 5 Drawing Sheets

(51) Int. Cl.
*D01F 8/06* (2006.01)
*D01F 8/16* (2006.01)

(52) U.S. Cl.
CPC .... *D10B 2321/021* (2013.01); *D10B 2331/10* (2013.01); *D10B 2401/061* (2013.01)

(58) Field of Classification Search
USPC ..... 442/361, 364, 359
See application file for complete search history.

(56) References Cited

U.S. PATENT DOCUMENTS

| | | | | |
|---|---|---|---|---|
| 5,681,302 | A | 10/1997 | Melbye | |
| 6,225,243 | B1 * | 5/2001 | Austin | D01F 8/06 442/328 |
| 8,021,995 | B2 | 9/2011 | Suzuki | |
| 2003/0144643 | A1 * | 7/2003 | Jarpenberg | A61F 13/15593 604/385.24 |
| 2004/0214498 | A1 * | 10/2004 | Webb | D01F 8/06 442/329 |
| 2005/0164587 | A1 * | 7/2005 | Melik | C08L 23/10 442/361 |
| 2009/0264038 | A1 | 10/2009 | Boscolo | |
| 2010/0105273 | A1 | 4/2010 | Motomura | |
| 2011/0250390 | A1 | 10/2011 | Terada | |
| 2013/0310789 | A1 * | 11/2013 | Wade | A61F 13/64 604/385.3 |

FOREIGN PATENT DOCUMENTS

| | | |
|---|---|---|
| EP | 2034057 | 3/2009 |
| JP | 61-88934 | 5/1986 |
| JP | 4-73214 | 3/1992 |
| JP | H04-126815 | 4/1992 |
| JP | 9-285484 | 11/1997 |
| JP | H09-291454 | * 11/1997 |
| JP | 2001-003252 | 1/2001 |
| JP | 2007-526410 | 9/2007 |
| JP | 2012-144840 | 8/2012 |
| WO | WO 2012/070518 | 5/2012 |
| WO | WO 2013-090519 | 6/2013 |

OTHER PUBLICATIONS

Technical data sheet, Entec, Lubrizol Advanced Materials ESTANE 2355-75A TPU, retrieved Jul. 19, 2016.*
International Search Report for PCT International Application No. PCT/US2013/069087, dated Feb. 5, 2014, 4pgs.
Supplementary European Search Report from EP 13852658, dated Jun. 15, 2016, 4 pages.

* cited by examiner

NONWOVEN AND STRETCHABLE LAMINATE

CROSS REFERENCE TO RELATED APPLICATIONS

This application is a national stage filing under 35 U.S.C. 371 of PCT/US2013/069087, filed Nov. 8, 2013, which claims priority to Japanese Application No. 2012-246341, filed Nov. 8, 2012, the disclosure of which is incorporated by reference in its/their entirety herein.

FIELD OF THE INVENTION

The present invention relates to a nonwoven and stretchable laminate.

BACKGROUND

Various types of nonwovens are used in sanitary articles, domestic products, or the like. For example, Japanese Unexamined Patent Application Publication No. 2012-144840A discloses melt spinning according to a method of spun bonding by simultaneous extrusion of different types of molten polymers composed of elastomers and polyolefins from different nozzles arranged on the same die, and discloses a nonwoven that has undergone entangling processing by hot emboss processing of a nonwoven web composed of mixed fibers as a mixture of fibers composed of elastomers and fibers composed of polyolefins.

Moreover, Japanese Unexamined Patent Application Publication No. 2011-219900A discloses a stretchable nonwoven composed of a fiber layer (1) including thermo-adhesive fibers and a fiber layer (2) including composite fibers of resin components different from one another, which is laminated on at least one surface of the fiber layer (1). Both fiber layers are integrated, such that the fibers of both fiber layers are not pressure-bonded and flattened at a thermal bonding part partially formed by thermal bonding of the thermo-adhesive fiber. A convex structure of the fiber layer (1) projecting toward the fiber layer (1) side is formed between the thermal bonding parts.

SUMMARY

Differences in performance may occur in a conventional nonwoven for the machine direction (i.e. feed direction of the nonwoven during manufacture) versus the cross direction (i.e. direction perpendicular to the machine direction). That is to say, stretchability of a nonwoven is generally anisotropic, and when a conventional material is used, it has been difficult to readily provide sufficient stretchability in both directions, due to production constraints.

According to the present invention, it is possible to provide a nonwoven that readily has sufficient elongation (stretchability) in both the machine direction and the cross direction, and the present invention is able to provide a laminate including this nonwoven. In certain embodiments of the present invention, the nonwoven and laminate have excellent feel and appearance in addition to the excellent stretchability. Such a nonwoven and laminate may be used appropriately for applications where there is direct contact with the skin.

The present invention provides a nonwoven comprising fibers having a core-in-sheath structure comprising a core part and a sheath part; the core part comprising a thermoplastic elastomer; and the sheath part comprising a polyolefin of lower viscosity than the thermoplastic elastomer at a specific temperature selected in a temperature range of greater than or equal to 220° C. to less than or equal to 260° C., and a melt flow rate of the polyolefin being greater than or equal to 100 g/10 minutes.

A fiber having the core-in-sheath structure is used in the nonwoven of the present invention, specific types of polymers are used for the core part and sheath part, the fluidity and viscosity of the polymer used for the sheath part are specified, and the like. Thus, the nonwoven of the present invention readily has sufficient elongation (stretchability) in both directions, i.e. the machine direction (MD) and the cross direction (CD).

The thermoplastic elastomer may be a thermoplastic polyurethane. It is possible to realize more excellent stretchability of the nonwoven by use of the thermoplastic polyurethane.

Linear low density polyethylene may be used as the polyolefin. Feel of the obtained nonwoven may be improved by use of the linear low density polyethylene.

A nonwoven can have a stress at 50% elongation of less than or equal to 1.3 N/25 mm. Due to elasticity at this stress, even if a strong force is not applied, the nonwoven deforms in a flexible manner in both the MD and TD directions. Therefore, it is possible to use this nonwoven with advantage for applications that require excellent stretchability without directional dependencies, such as a diaper or the like.

One surface of the nonwoven may be produced as a smooth surface. By making one surface as a smooth surface, the nonwoven may be used with advantage in applications requiring good appearance or glossiness and applications requiring excellent feel. Further, the expression "smooth surface" is taken to mean the surface that has the highest smoothness in the case where the surfaces of the nonwoven have different degrees of smoothness from one another. For example, if, between both surfaces, there is a difference in average indentation depth as determined based on JIS B0601, the "smooth surface" is the surface having the lower average indentation depth value (preferably the surface having an average indentation depth that is smaller by at least 10%).

The nonwoven may be used to provide a stretchable laminate. That is to say, a stretchable laminate can be provided comprising the nonwoven, and a plurality of elastomer strands disposed with distances therebetween, wherein the elastomer strands have regions in which the elastomer strands are joined to the nonwoven, and regions in which the elastomer strands are separated from the nonwoven.

Thus, an object of the present invention is to readily provide a nonwoven that has sufficient elongation (stretchability) in both direction, i.e. the machine direction and the cross direction. Another object of the present invention is to provide a laminate including this nonwoven.

DETAILED DESCRIPTION

Figure 1A:
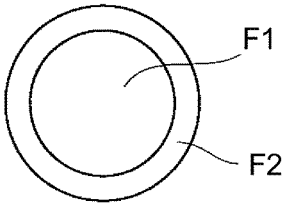
FIG. 1A illustrates a schematic cross-sectional drawing of a first embodiment fiber.

Embodiments of the present invention are described in detail below while referring to the drawings, but the present invention is not limited to the embodiments below. In the description below, same reference numerals are assigned to same or similar portions, and redundant descriptions are omitted.

The nonwoven of the embodiment of the present invention includes a fiber (composite fiber) having a core-in-sheath structure. The nonwoven may be composed of only the fibers having the core-in-sheath structure, or alternatively, may be composed of fibers having the core-in-sheath structure and fibers not having a core-in-sheath structure. For readily imparting flexible deformation without directional dependencies to the nonwoven, the nonwoven is preferably composed of only the fibers having the core-in-sheath structure. Furthermore, no particular limitation is placed on the cross-sectional shape perpendicular to the lengthwise direction of the fibers having the core-in-sheath structure, and this shape is exemplified by a circular shape and flattened shape. A roughly circular shape is preferred for ease of production.

The expression "a fiber having a core-in-sheath structure" means a fiber that has a structure, when viewed in the cross section that is perpendicular to the lengthwise direction of the fiber, composed of a core part as well as a sheath part covering at least a part of the core part. FIGS. 1A to 1D illustrate schematic cross-sectional views of fibers having the core-in-sheath structure. FIGS. 1A, 1B, 1C, 1D, 1E, and 1F are schematic cross-sectional views of the first, second, third, fourth, fifth, and sixth embodiment, respectively. The fiber of the first embodiment illustrated in FIG. 1A has a structure where the core part F1 is covered by the sheath part F2 so that the sheath part F2 is concentrically arranged with the core part F1. The fiber of the second embodiment illustrated in FIG. 1B has a structure in which the core part F1 is covered by the sheath part F2. However, this embodiment differs from the first embodiment in that the core part F1 is disposed eccentrically as viewed in the cross-sectional direction of the fiber. The fiber of the third embodiment illustrated in FIG. 1C has a structure similar to that of the fiber of the second embodiment except that the core part F1 has an irregularly shaped cross-sectional surface.

Figure 1D:
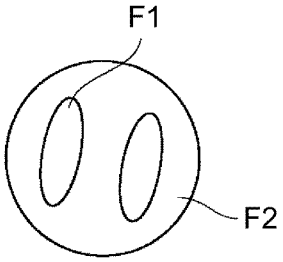
FIG. 1D illustrates a schematic cross-sectional drawing of a fourth embodiment fiber.
Figure 1B:
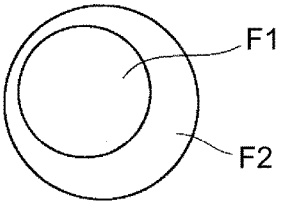
FIG. 1B illustrates a schematic cross-sectional drawing of a second embodiment fiber.
Figure 1E:
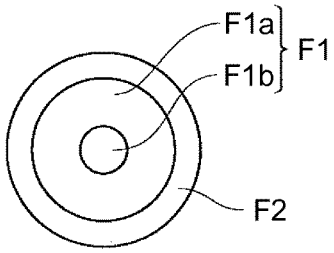
FIG. 1E illustrates a schematic cross-sectional drawing of a fifth embodiment fiber.
Figure 1C:
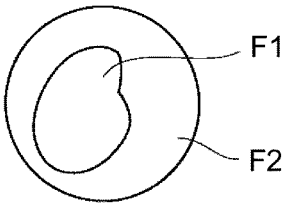
FIG. 1C illustrates a schematic cross-sectional drawing of a third embodiment fiber.
Figure 1F:
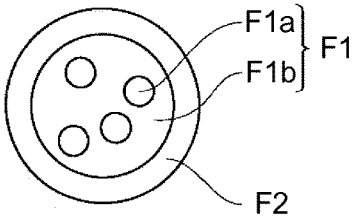
FIG. 1F illustrates a schematic cross-sectional drawing of a sixth embodiment fiber.

The fiber of the fourth embodiment illustrated in FIG. 1D has a structure in which a plurality of core parts F1 of an ellipsoidal cross-sectional shape is covered by the sheath part F2. The fiber of the fifth embodiment illustrated in FIG. 1E has a structure in which the core part F1 is covered by the sheath part F2; however, the core part F1 is composed of a first core part F1*a* and a second core part F1*b* covering the first core part F1*a*, and the first core part F1*a* and the second core part F1*b* are disposed concentrically. The fiber of the sixth embodiment illustrated in FIG. 1F has a structure in which the core part F1 is covered by the sheath part F2; however, the core part F1 is composed of first core parts F1*a* and a second core part F1*b*, and a plurality of the first core parts F1*a* are disposed within the second core part F1*b*.

Although any desired ratio may be used as the ratio of the fiber cross-sectional area occupied by the core part F1 to the sheath part F2, the cross-sectional area of the core part F1 is preferably large in comparison to the cross-sectional area of the sheath part F2.

A diameter of the fiber having the core-in-sheath structure is preferably greater than or equal to 5 μm and less than or equal to 25 μm, further preferably is greater than or equal to 8 μm and less than or equal to 20 μm, and most preferably is greater than or equal to 10 μm and less than or equal to 15 μm. When the diameter of the fiber having the core-in-sheath structure is in the aforementioned range, it is possible to impart pliability to the obtained nonwoven.

Although no particular limitation is placed on the length of the fibers having the core-in-sheath structure, as long as the fibers are able to form a nonwoven, long fibers are preferred. The expression "long fiber" means a fiber having an average fiber length of at least 25 mm measured in accordance with JIS L1015, average fiber length measurement method (C method).

The fibers having the core-in-sheath structure preferably have an elongation recovery from 100% elongation of greater than or equal to 20%, further preferably greater than or equal to 35%, and most preferably greater than or equal to 50%. When the elongation recovery of the fibers having the core-in-sheath structure is in the aforementioned range, stretchability is excellent, and such fibers are particularly suitable for various types of applications such as diapers or the like.

The thermoplastic elastomer described below is used for the core part F1, and the polyolefin described below is used for the sheath part F2, constituting the fibers having the core-in-sheath structure.

The thermoplastic elastomer contained in the core part F1 is a material capable of adjusting stretchability of the obtained nonwoven. The molecule of the thermoplastic elastomer generally is composed of flexible components (soft segments, flexible phase) having rubbery elasticity and molecule restraining components (hard segments, hard phase) for preventing plastic deformation. The thermoplastic elastomer may be classified according to the type of these hard segments. The utilized thermoplastic elastomer included in the core part F1 is preferably a polymer such as (1) a urethane-based thermoplastic elastomer (TPU), (2) an ester-based thermoplastic elastomer, (3) an olefin-based thermoplastic elastomer (TPO), (4) a styrene-based thermoplastic elastomer, (5) a vinyl chloride-based thermoplastic elastomer, (6) an amide-based thermoplastic elastomer, (7) a syndiotactic poly(1,2-butadiene), (8) a poly(trans-1,4-isoprene), or the like.

Among these, (1) urethane-based thermoplastic elastomers, (2) ester-based thermoplastic elastomers, (3) olefin-based thermoplastic elastomers, (4) styrene-based thermoplastic elastomers, and combinations thereof are preferable, (1) urethane-based thermoplastic elastomers, (2) ester-based thermoplastic elastomers, (4) styrene-based thermoplastic elastomers, and combinations thereof are more preferable; and (1) urethane-based thermoplastic elastomers, (4) styrene-based thermoplastic elastomers, and combinations thereof are even more preferable.

Moreover, an olefin resin may be intermixed with the thermoplastic elastomer. The hardness of the core part F1 may be adjusted by addition of the olefin resin. Moreover, processability of the thermoplastic elastomer included in the core part F1 can be improved. The olefin resin is exemplified by a polypropylene, a maleic acid-modified polypropylene, a polyethylene, an ethylene-α-olefin copolymer, an ethylene-glycidyl methacrylate copolymer, an ethylene-methyl methacrylate copolymer, a propylene-styrene copolymer, an ethylene-styrene copolymer, or the like.

The added amount of the olefin resin relative to 100 parts by weight of the thermoplastic elastomer or 100 parts by weight of the combination with the thermoplastic elastomer is from 1.0 to 200 parts by weight.

The (1) urethane-based thermoplastic elastomer is a polymer that has urethane bonds in the molecule and displays fluidity when heated. Thermoplastic polyurethane elastomers having excellent stretchability are suitable as the urethane-based thermoplastic elastomer.

The thermoplastic polyurethane elastomer is generally obtained by a polyaddition reaction between a polyol (i.e. long chain polyol, short chain polyol, or the like) and an isocyanate (i.e. diisocyanate or the like). The thermoplastic polyurethane elastomer has a urethane bond in the molecule. Here, a long chain polyol forms the flexible component, and a short chain polyol and diisocyanate form the molecule restraining component.

Polyols used as raw material for the thermoplastic polyurethane elastomer are represented by polyester-based polyols (such as the adipate type, polycaprolactone type, or the like), polyether type polyols, or the like. Examples of long-chain polyols include polyether diols (for example, poly(oxytetramethylene)glycol and poly(oxypropylene)glycol), polyester diols (for example, poly(ethylene adipate) glycol, poly(1,4-butylene adipate)glycol, poly(1,6-hexylene adipate)glycol, and poly(hexanediol 1,6-carbonate)glycol), and the like. Examples of short-chain polyols include ethylene glycol, 1,3-propylene glycol, bisphenol-A, 1,4-butanediol, 1,4-hexanediol, and the like.

Any of aromatic type isocyanates, aliphatic type isocyanates, and alicyclic type isocyanates may be used as diisocyanates, exemplified by 4,4'-diphenylmethane diisocyanate, toluene diisocyanate, hexamethylene diisocyanate, or the like.

The urethane-based thermoplastic elastomer may be used as a single type in the core part F1, or a combination of two or more types of urethane-based thermoplastic elastomer may be used.

Examples of elastomers that are preferable for use as the (2) ester-based thermoplastic elastomers include ester-based elastomers containing a block having an aromatic polyester as the hard segment and a block having an aliphatic polyether or an aliphatic polyester as the soft segment, and the like.

Use of an ethylene-α-olefin copolymer prepared using metallocene as a catalyst for the (3) olefin-based thermoplastic elastomer is particularly preferable, especially considering processability, cost, light resistance, chemical resistance, skin irritation, and the like. Examples of α-olefins copolymerized with ethylene in the ethylene-α-olefin copolymer include α-olefins having from 3 to 30 carbon atoms, for example, propylene, 1-butene, 1-pentene, 1-hexene, 1-octene, 1-heptene, 4-methyl-1-pentene, 4-methyl-1-hexene, 4,4-dimethyl-1-pentene, octadecene, and the like. Among these, the use of 1-hexene, 1-octene, 1-heptene, and 4-methyl-1-pentene is preferred. A preferred mixture ratio of ethylene and α-olefin in the ethylene-α-olefin copolymer is from 40% by weight or more to 98% by weight or less of ethylene and from 60% by weight or less to 2% by weight or more of α-olefin.

Specific examples of the (4) styrene-based thermoplastic elastomers that can be used include various types of tertiary block polymer materials having aromatic vinyl-conjugated diene (or one in which a portion or all of the unsaturated bonds thereof are hydrogenated)-aromatic vinyl block copolymers as basic structures. Styrene is desirable as the vinyl monomer constituting the aromatic vinyl polymer. Moreover, isoprene is desirable as the monomer constituting the conjugated diene. A part or all of the unsaturated bonds thereof may be hydrogenated at the time when used as a styrene-based thermoplastic elastomer.

The (4) styrene-based thermoplastic elastomer is exemplified by styrene-ethylene butylene-styrene block copolymer (SEBS), styrene-ethylene propylene-styrene block copolymer (SEPS), styrene-ethylene butylene-ethylene block copolymer (SEBC), ethylene-ethylene butylene-ethylene block copolymer (CEBC), or the like. If an SEBS copolymer is used as the styrene-based thermoplastic elastomer, relative to 100% by weight of the total SEBS copolymer, the styrene content is preferably greater than or equal to 10% by weight and less than or equal to 25% by weight.

In addition to the thermoplastic elastomer, the core part F1 may further include an additive such as a tackifier (adhesivity-imparting agent) or the like.

Tackifiers having good compatibility with the polymers are preferred. When a blended polymer of the (1) urethane-based thermoplastic elastomer and the (4) styrene-based thermoplastic elastomer is used as the polymer component, a blended polymer that does not damage the structure of the urethane-based thermoplastic elastomer and that has good compatibility with the styrene-based thermoplastic elastomer is preferred. As the tackifier, rosin-based, terpene-based, and petroleum-based tackifiers, and the like can be used.

The softening point of the tackifier may be in a temperature range greater than or equal to 40° C. and less than or equal to 160° C., or may be in a temperature range greater than or equal to 70° C. and less than or equal to 160° C. Also, two or more kinds of tackifiers can be used in combination.

The amount of the tackifier relative to the total thermoplastic elastomer may be greater than or equal to 0.1% by weight and less than or equal to 10% by weight.

The core part F1 may further include various types of additives such as antioxidants, weathering agents, UV absorbers, colorants, inorganic fillers, oils, or the like. For example, thermoplastic plastics, oil components, or the like, may be added in order to modify the melt fluidity of the thermoplastic elastomers.

The shear viscosity of the thermoplastic elastomer is preferably greater than or equal to 2.5 Pa·s, further preferably is greater than or equal to 5.0 Pa·s, and most preferably is greater than or equal to 7.5 Pa·s. Furthermore, no particular limit is placed on the upper limit of shear viscosity of the thermoplastic elastomer, and any shear viscosity is permissible as long as manufacturing of the nonwoven by the below described method is possible. A shear viscosity of the thermoplastic elastomer in the aforementioned range is preferred due to the ability to more readily manufacture the fibers having the core-in-sheath structure by combination with the sheath part-forming polyolefin. Here, "shear viscosity" may be measured by sandwiching the sample between opposing components and performing measurement while applying a shear force (DMA measurement). Details of the measurement method will be described in the working examples. Measurement of shear viscosity may be performed using a viscoelasticity measurement apparatus (ARES) manufactured by TA Instruments Japan Inc., for example.

The melt flow rate of the thermoplastic elastomer is preferably less than or equal to 160 g/10 minutes, further preferably is less than or equal to 15 g/10 minutes, and most preferably is less than or equal to 10 g/10 minutes. On the other hand, the lower limit of the melt flow rate of the thermoplastic elastomer may be set to greater than or equal to 1 g/10 minutes, for example. If the melt flow rate of the thermoplastic elastomer is in the aforementioned range, it is possible to more readily produce the fibers having the core-in-sheath structure by combination of the thermoplastic elastomer with the polyolefin. Here, the term "melt flow rate" indicates the value measured based on ASTM D 1238 (measurement temperature: 190° C., measurement load: 2.16 kg).

The Shore A hardness (JIS A hardness) of the thermoplastic elastomer is preferably greater than or equal to 50 and less than or equal to 75. When a thermoplastic elastomer with a Shore A hardness (JIS A hardness) in the range greater than or equal to 50 and less than or equal to 75 is used as the core part F1, it is possible to obtain fibers having the core-in-sheath structure that have good stretchability and flexibility.

The sheath part F2 includes a polyolefin that has a melt flow rate greater than or equal to 100 g/10 minutes, and has a viscosity lower than that of the thermoplastic elastomer at a specific temperature selected in a range of temperatures greater than or equal to 220° C. and less than or equal to 260° C. That is to say, the polyolefin included in the sheath part F2 should have a viscosity that is less than the viscosity of the thermoplastic elastomer at a certain selected temperature as a "melt temperature" in the range of 220° C. to 260° C. (typically, a temperature can be selected as the temperature during production of the nonwoven, or as the die temperature in the case of production by the below described melt-blown method; this "melt temperature" may be set to 240° C., for example). The viscosity of the polyolefin is preferably measured based on the "shear viscosity" measurement method described above. For example, a shear viscosity may be adopted that is measured at the "melt temperature" and a shear rate of 150 $s^{-1}$.

Furthermore, when a thermoplastic polyurethane elastomer is used as the core part F1, materials for the core part F1 and the sheath part F2 are preferably selected such that at a melt temperature of 240° C., in a shear rate range varying from 10 $s^{-1}$ to 100 $s^{-1}$, the shear viscosity of the polyolefin included in the sheath part F2 is higher than the shear viscosity of the thermoplastic polyurethane elastomer included in the core part F1; and in a shear rate range exceeding 100 $s^{-1}$ and up to 200 $s^{-1}$, the shear viscosity relationship reverses (i.e. shear viscosity of the polyolefin included in the sheath part F2 becomes lower than the shear viscosity of the thermoplastic polyurethane included in the core part F1). Particularly preferably, at a melt temperature of 240° C., when the shear rate is varied from 10 $s^{-1}$ to 100 $s^{-1}$, the material has a low decrease in the shear viscosity (e.g. change of viscosity within ±10% in this shear rate range). Moreover, the shear viscosity at a 150 $s^{-1}$ shear rate and a 240° C. temperature for the polyolefin included in the sheath part F2 is preferably less than or equal to 30 Pa·s, and further preferably is less than or equal to 10 Pa·s.

The melt flow rate of the polyolefin indicates the value measured based on ASTM D 1238 (measurement temperature: 190° C., measurement load: 2.16 kg). As mentioned above, this value is higher than the value for the thermoplastic elastomer included in the core part, and the value of the melt flow rate of the polyolefin is preferably greater than or equal to 100 g/10 minutes. When the melt flow rate of the polyolefin is in the aforementioned range, it is possible to readily produce the fibers having the core-in-sheath structure by combination of the polyolefin with the thermoplastic elastomer. Furthermore, although no particular limit is placed on the upper limit of the melt flow rate of the polyolefin, this upper limit may be set to less than or equal to 1,500 g/10 minutes, for example.

Furthermore, examples of the polyolefin included in the sheath part F2 include olefin resins such as polyethylene, polypropylene, or the like. Crystalline and non-crystalline polyolefins may be used as the polyolefin included in the sheath part F2. Examples of polyethylenes include low density polyethylene (LDPE), linear low density polyethylene (LLDPE), and high density polyethylene (HDPE), and examples of polypropylenes include propylene homopolymers, propylene-based binary copolymers, and propylene-based ternary copolymers. Among the above examples, crystalline polypropylene or low crystallinity (degree of crystallization=about 45 to 55%) polyethylene is preferably used as the olefin resin.

Polyethylenes are exemplified by low density polyethylene (LDPE), linear low density polyethylene (LLDPE), and high density polyethylene (HDPE). Among these examples, linear low density polyethylene (LLDPE) is preferred.

Linear low density polyethylene (LLDPE) is a copolymer of ethylene (i.e. main component) and a small amount of an α-olefin. Linear low density polyethylene is typically produced using a coordinating anion polymerization catalyst such as a Ziegler-Natta catalyst or the like. Linear low density polyethylene has a density of about 0.910 to 0.925 (JIS K 7112). Although the crystallinity and density are low, for low distortion after elongation, the density is preferably in the range of greater than or equal to 0.915 g/$cm^3$ and less than or equal to 0.940 g/$cm^3$. The α-olefin monomer used for copolymerization is exemplified by 1-butene, 1-hexene, 4-methylpentene, 1-octene, or like α-olefins having 4 to 8 carbon atoms.

The crystalline polypropylene can be used with no particular limitation provided that it has hard elasticity. Preferable examples of the crystalline polypropylene include homopolymers of propylene, copolymers mainly of propylene with ethylene, copolymers mainly of propylene with α-olefins, and the like.

The preferred crystallinity of the crystalline polypropylene is 40% or more. The elongation recovery of the fiber may be insufficient when the crystallinity is less than 40%. The crystallinity is a value calculated based on the energy required to melt the crystal as measured by DSC (differential scanning calorimetry).

A preferred weight average molecular weight of the crystalline polypropylene is from 10,000 or more to 1,000,000 or less, and is more preferably from 20,000 or more to 600,000 or less, from the perspective of readily expressing a stretching elasticity.

The nonwoven may be produced by the below described melt-blown method, for example. That is to say, a blown microfiber (BMF) device may be used that is equipped with a first extruder, a second extruder, and a melt-blown die having an orifice and a feed block-splitter assembly. It is possible to prepare the fibers having the core-in-sheath structure by use of this type of BMF device. This fiber is blown against a drum rotating at a drum rotation speed sufficiently slower than the speed of flow of the fibers, and the fibers are collected on the surface of the drum so as to be able to form a web and produce the nonwoven. It is also possible to produce the nonwoven continuously by using drums to wind the web into a roll.

Firstly, the thermoplastic elastomer for forming the core part is melted by the first extruder, and the polyolefin for forming the sheath part is melted by the second extruder, and the molten resins are supplied to the feed block-splitter assembly. The flow of the supplied molten resin is split thereafter into a plurality of molten resin flows by the feed block-splitter assembly. The split molten resin flows are maintained in a state so as to prevent mutual direct contact until immediately prior to reaching the die. Due to the configuration in this manner, it is possible to suppress destabilization of the flows of the molten resins that would result from contact of molten resins of different compositions.

The flows of the molten resins are integrated together immediately prior to reaching the die so as to form a three layered molten resin flow (i.e. polyolefin/thermoplastic elastomer/polyolefin), and then extruded from the die. It is possible to adjust the feed rates of the molten resins by adjusting a gear pump. Due to such adjustment, it is possible to control the ratios of the thermoplastic elastomer to polyolefin in the integrated molten resin, and it is possible to adjust the performance of the obtained fibers having the core-in-sheath structure.

Thereafter, heated air at a uniform high velocity is fed to the three layered molten resin extruded from the die. Due to the high velocity flow of the supplied air, the flow of extruded molten resin is stretched and elongated. The structure of the fiber changes according to the viscosity relationship and the melt flow rates of the molten resin layers constituting the aforementioned three layers. If the melt flow rate of the polyolefin is higher than that of the thermoplastic elastomer and the polyolefin has a lower viscosity than that of the thermoplastic elastomer, the layer formed from the polyolefin fuses so as to envelope the intermediate layer, and it is possible to obtain fibers having the core-in-sheath structure provided with a core part and a sheath part. The fibers having the core-in-sheath structure obtained by extrusion in this manner are blown against a drum rotating at a sufficiently slow rotational speed lower than the flow velocity of the fibers, a web is formed by collecting the fibers on the surface of the drum, and it is possible to produce a nonwoven. Furthermore, it is possible for the aforementioned types of other components to coexist with the polyolefin and thermoplastic elastomer described above.

The nonwoven produced by the aforementioned method has an MD (i.e. feed direction of the nonwoven during production) and a CD (perpendicular to the MD). However, there is no directional dependency of the nonwoven of the present embodiment, and flexible elongation and deformation are possible in both the MD and CD directions.

In both the machine direction and the cross direction, a stress of the nonwoven at 50% elongation is preferably less than or equal to 1.3 N/25 mm, further preferably is less than or equal to 1.0 N/25 mm, and most preferably is less than or equal to 0.5 N/25 mm. On the other hand, the lower limit of the stress of the nonwoven at 50% elongation, for example, may be greater than or equal to 0.1 N/25 mm. The stress of the nonwoven at 50% elongation is preferably in the aforementioned range due to the ability to readily elongate the nonwoven.

One surface of the nonwoven may be made as a smooth surface. The one surface of the smooth surface of the nonwoven may be prepared by controlling a distance between the nozzle holes and the winding drum collecting the fibers having the core-in-sheath structure during the production of the nonwoven.

The basis weight of the nonwoven is preferably less than or equal to 30 g/m$^2$, further preferably is greater than or equal to 8 g/m$^2$ and less than or equal to 28 g/m$^2$, and most preferably is greater than or equal to 15 g/m$^2$ and less than or equal to 25 g/m$^2$. When the basis weight of the nonwoven is in the aforementioned range, the obtained nonwoven is light weight and has excellent air permeability. Moreover, when the basis weight of the nonwoven is in the aforementioned range, the bending resistance is low (i.e. less than or equal to 50 mm), the resultant nonwoven is soft, and the nonwoven deforms flexibly in both the MD and CD direction. By this means, the nonwoven becomes particularly suitable for applications such as diapers or the like. Here, "bending resistance" indicates the value measured based on the JIS L 1913 bending resistance measurement method (cantilever method).

The thickness of the nonwoven is determined by the basis weight and fiber diameter of the fibers constituting the nonwoven. Generally, the thickness of the nonwoven may be set in the range of 10 to 500 μm. When the thickness of the nonwoven is in the aforementioned range, the overall nonwoven is light weight and soft.

The elongation recovery from 100% elongation of the nonwoven is preferably greater than or equal to 20%, further preferably is greater than or equal to 35%, and most preferably is greater than or equal to 50%. When the elongation recovery of the nonwoven is in the aforementioned range, and for example, when the nonwoven is used as a sanitary article, the nonwoven has an excellent ability to conform to movement of the human body.

The stretchable laminate according to an embodiment of the present invention is a stretchable laminate comprising the nonwoven and a plurality of elastomer strands disposed with distances therebetween; and the elastomer strands comprising regions in which the elastomer strands are joined to the nonwoven, and regions in which the elastomer strands are separated from the nonwoven. By configuring the stretchable laminate in this manner, there is no impairment of the stretchability of the nonwoven, and it is possible to further increase the elongation recovery (e.g. to greater than or equal to 50%, and preferably from 80 to 90%).

Figure 2:
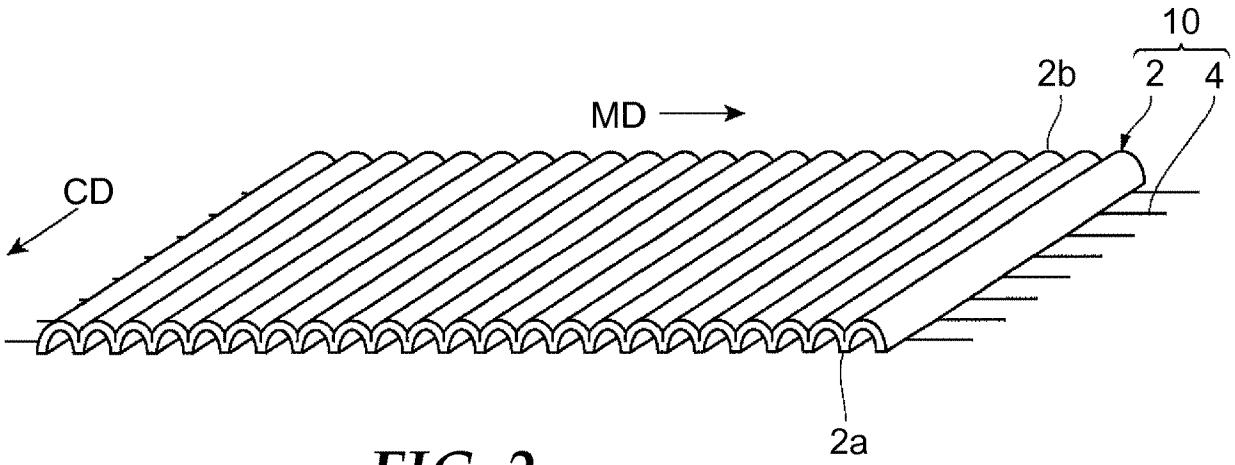
FIG. 2 is a perspective view of an example of a stretchable laminate having a two-layer structure.

FIG. 2 is a perspective view illustrating an example of a stretchable laminate having a two-layer structure. The two-layer structure stretchable laminate 10, as illustrated in FIG. 2, has a nonwoven 2 and has a plurality of elastomer strands 4 disposed unidirectionally in parallel with a distance between strands. The elastomer strands 4 have regions in which the elastomer strands 4 are joined to the nonwoven 2 and regions in which the elastomer strands 4 are separated from the nonwoven 2. In the example of FIG. 2, a corrugated pattern is formed in the nonwoven 2. The nonwoven 2 and elastomer strands 4 may be joined by a hot melt adhesion or may be joined by an adhesive agent.

As shown in FIG. 2, the elastomer strands 4 extend along the MD (machine direction) of the stretchable laminate 10, and multiple elastomer strands 4 are disposed with distances therebetween in the CD direction (cross direction, perpendicular to the MD direction) of the stretchable laminate 10. On the other hand, in the nonwoven 2 formed in a corrugated pattern, valley portions 2*a* (i.e. regions of bonding to the elastomer strands 4) and arch-like ridge portions 2*b* (i.e. regions of separation from the elastomer strands 4) are formed alternatingly in the MD direction. The valley portions 2*a* and the ridge portions 2*b* are formed so as to extend along the CD direction. The valley portions 2*a* are bonded to the elastomer strands 4 in a linear manner along lines extending in the CD direction. The shape of the ridge portions 2*b* is not limited to an arch-like shape as viewed in the CD direction. For example, the ridge portions 2*b* may have a square or triangular shape when viewed in the CD direction.

The stretchable laminate 10 is capable of changing elastic force, caused when stretching the stretchable laminate 10 in the MD direction, in two stages. That is to say, in a case with the stretchable laminate 10 stretched in the MD direction, the elastic force is not sufficiently exhibited until the ridge portions 2*b* where the nonwoven 2 is bent away from the elastomer strands 4 are stretched and flattened. Thus, in the initial stage, it is possible to stretch the stretchable laminate 10 using a low force that exceeds the elastic force of the elastomer strands 4. Then, when the stretchable laminate 10 has been stretched such that the ridge portions 2*b* have become flattened, elastic force of the nonwoven 2 is added to the elastic force of the elastomer strands 4, and it becomes impossible to stretch the stretchable laminate 10 using the same force that was used up until the ridge portions 2*b* became flattened.

Figure 3:
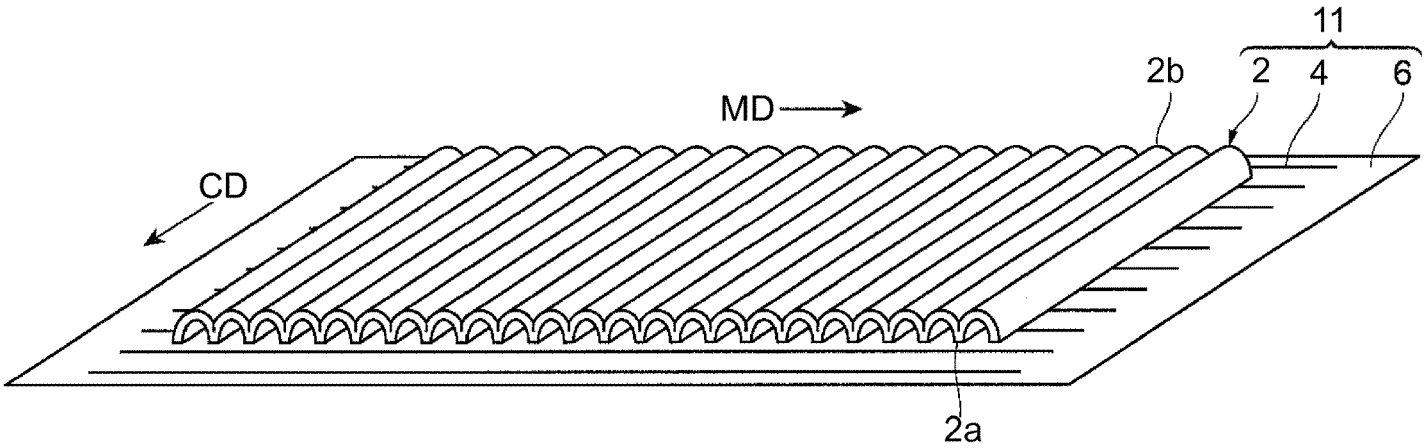
FIG. 3 is a perspective view of a different example of a stretchable laminate having a three-layer structure.

FIG. 3 is a perspective view showing one example of a stretchable laminate having a three-layer structure. The three-layer structure stretchable laminate 11 has a plurality of elastomer strands 4 disposed in parallel in the MD direction with distances therebetween, a nonwoven 2 formed in a corrugated pattern and disposed on the elastomer strands 4, and a nonwoven 6 disposed on the elastomer strands 4 on the side opposite to the nonwoven 2, as illustrated in FIG. 3.

The elastomer strands 4 have regions where the elastomer strands 4 are joined to the nonwoven 2, and regions where the elastomer strands 4 are separated from the nonwoven 2. Specifically, in the surface of the elastomer strands 4 opposite to the nonwoven 2, there are regions of bonding to the valley portions 2*a* of the nonwoven 2, and regions of separation from the ridge portions 2*b* of the nonwoven 2. That is to say, part of the surface of the elastomer strands 4 opposing the nonwoven 2 is not joined to the nonwoven 2. The nonwoven 2 and elastomer strands 4 may be joined by a hot melt adhesion or may be joined by an adhesive agent.

The stretchable laminate 11 has a three-layer structure having the nonwovens 2 and 6 on either side of the elastomer strands 4, and thus, it is possible to produce a surface of the stretchable laminate 11 formed by the flat nonwoven 6. This surface is suitable for use in a sanitary article and the like since the feel in contact with the skin is good, and since the flat surface does not easily leave contact marks on the skin.

In FIGS. 2 and 3, the number of ridge portions 2*b* per 1 cm in the cross direction of the corrugated pattern nonwoven 2 (pitch) is preferably greater than or equal to 0.39 $cm^{-1}$ and less than or equal to 11.8 $cm^{-1}$. Further, a preferred difference between the heights of the lower ends of the valley portions 2*a* and the upper ends of the ridge portions 2*b* is from 0.1 mm or more to 5 mm or less. On the other hand, a preferred width of the ridge portions 2*b* is in a range from 0.1 mm or more to 5 mm or less.

The fiber diameter of the elastomer strand 4 is preferably greater than or equal to 15 μm and less than or equal to 2 mm, further preferably is greater than or equal to 50 μm and less than or equal to 1 mm, and most preferably is greater than or equal to 100 μm and less than or equal to 500 μm. When the fiber diameter of the elastomer strand 4 is in the aforementioned range, the stretchability of the obtained stretchable laminate is excellent.

The elongation recovery from 100% elongation of the elastomer strand 4 is preferably greater than or equal to 20%, further preferably is greater than or equal to 35%, and most preferably is greater than or equal to 50%. When the stretchable laminate is used as a sanitary article, for example, the use of elastomer strands 4 having an elongation recovery in the aforementioned range is preferred for an excellent ability to conform to movement of the human body.

The elastomer strands 4 are preferably formed from a material capable of adjusting stretchability, and a thermoplastic elastomer is particularly suitable as this material. At least one of the thermoplastic elastomers described concerning the fibers having the core-in-sheath structure and constituting the nonwoven may be used as this thermoplastic elastomer.

If the (4) styrene-based thermoplastic elastomer is used in the elastomer strand 4, representative examples of the styrene-based thermoplastic elastomers are styrene-isoprene-styrene block copolymers (SIS copolymers).

When an SIS copolymer is used, a proportion of styrene per 100% by weight total weight of the SIS copolymer is preferably 10% by weight or higher, and more preferably 15% by weight or higher, and is preferably 50% by weight or lower, and particularly preferably 45% by weight or lower.

From the standpoints of fluidity (processability) and stability of the elastomer strand 4, the melt flow rate of the SIS copolymer is preferably high, and in certain embodiments, this fluidity may be greater than or equal to 10 and less than or equal to 45. Also, in certain embodiments, a lower limit of the melt flow rate of the SIS copolymer can be set at 20 and an upper limit can be set at 40. Here, the term "melt flow rate" indicates the value measured based on ASTM D 1238 (measurement temperature: 200° C., measurement load: 5.0 kg).

Unmodified types and modified types of SIS copolymers can be used. A modified SIS copolymer can be obtained by, for example, bringing about an addition reaction (for example, grafting) of an unsaturated carboxylic acid or derivative thereof on an SIS copolymer. Specific examples include maleic acid, fumaric acid, itaconic acid, acrylic acid, crotonic acid, endo-bi-cyclo-[2,2,1]-5-heptene-2,3-dicarboxylic acid, cis-4-cyclohexene-1,2-dicarboxylic acid, and anhydrides and imides thereof.

An SIS copolymer having a skeleton with three or more branches can be used as the SIS copolymer. Moreover, in certain aspects, two or more kinds of SIS copolymers may be used in combination.

Tackifiers (tackifying agents) and other additives may be included in addition to these polymer components in the elastomer strand 4. As these additives, the same additives described concerning the fibers having the core-in-sheath structure constituting the nonwoven can be used.

The elastomer strand 4 is preferably a fiber having a core-in-sheath structure. The cross-sectional shape perpendicular to the lengthwise direction of the fiber, core-in-sheath structures, cross-sectional area ratios of the core part to the sheath part, and the like described concerning the fibers having the core-in-sheath structure constituting the nonwoven are suitable for the elastomer strand 4.

The aforementioned thermoplastic elastomers described as being used for the core part may be used in the elastomer strands 4. Among such thermoplastic elastomers, the use of styrene-based thermoplastic elastomers is preferred. An example of a styrene-based thermoplastic elastomer is the (4) styrene-based thermoplastic elastomer described above. The proportion of styrene in the styrene-based thermoplastic elastomer, the melt flow rate in the case of an SIS copolymer, the potential to use the native/denatured states, the presence or absence of a branched structure, as well as the presence or absence, content, and types of additives such as tackifiers are as described above.

The material of the sheath part is preferably a material capable of hot melt adhesion to the nonwoven 2 and the nonwoven 6. Since the nonwoven 2 described above is formed from the fibers having the core-in-sheath structure comprising the core part F1 and the sheath part F2 covering the core part F1, the utilized material of the sheath part of the elastomer strand 4 preferably has hot melt adhesion to the sheath part F2 of the fibers constituting the nonwoven.

A non-elastomeric component may be used as the sheath part of the elastomer strand 4 having hot melt adhesivity. Examples of non-elastomeric components include olefin-based resins such as polyethylene, polypropylene, and the like, or polyester-based resins such as polyethylene terephthalate (PET), polybutylene terephthalate (PBT), and the like. A crystalline or non-crystalline component may be used for the non-elastomeric component. Examples of polyethylenes include low density polyethylene (LDPE), linear low density polyethylene (LLDPE), and high density polyethylene (HDPE), and examples of polypropylenes include propylene homopolymers, propylene-based binary copolymers, and propylene-based ternary copolymers. From the standpoint of hot melt adhesion to the sheath part F2 of the fibers constituting the nonwoven, the sheath part of the elastomer strand 4 is preferably made from the same component as that of the sheath part F2. Particularly, from the standpoint of the skin feel, the sheath part component of the elastomer strand 4 and the sheath material F2 are preferably linear low density polyethylene.

The utilized linear low density polyethylene may be the same type of linear low density polyethylene as that of the sheath part F2 in the fibers having the core-in-sheath structure constituting the nonwoven described above.

When the elastomer strand 4 is composed of fibers having the core-in-sheath structure in this manner, due to the elastomer strand 4 having a sheath part that has hot melt adhesion to the sheath part F2 of the fibers constituting the nonwoven, it is possible to realize strong bonding between the elastomer strand 4 and the nonwoven 2 and nonwoven 6 by hot melt adhesion. Moreover, due to the ability to strongly bond the elastomer strand 4 to the nonwoven 2 and the nonwoven 6 by hot melt adhesion, there is no need for using an adhesive agent during production of the stretchable laminates 10 and 11.

Figure 4:
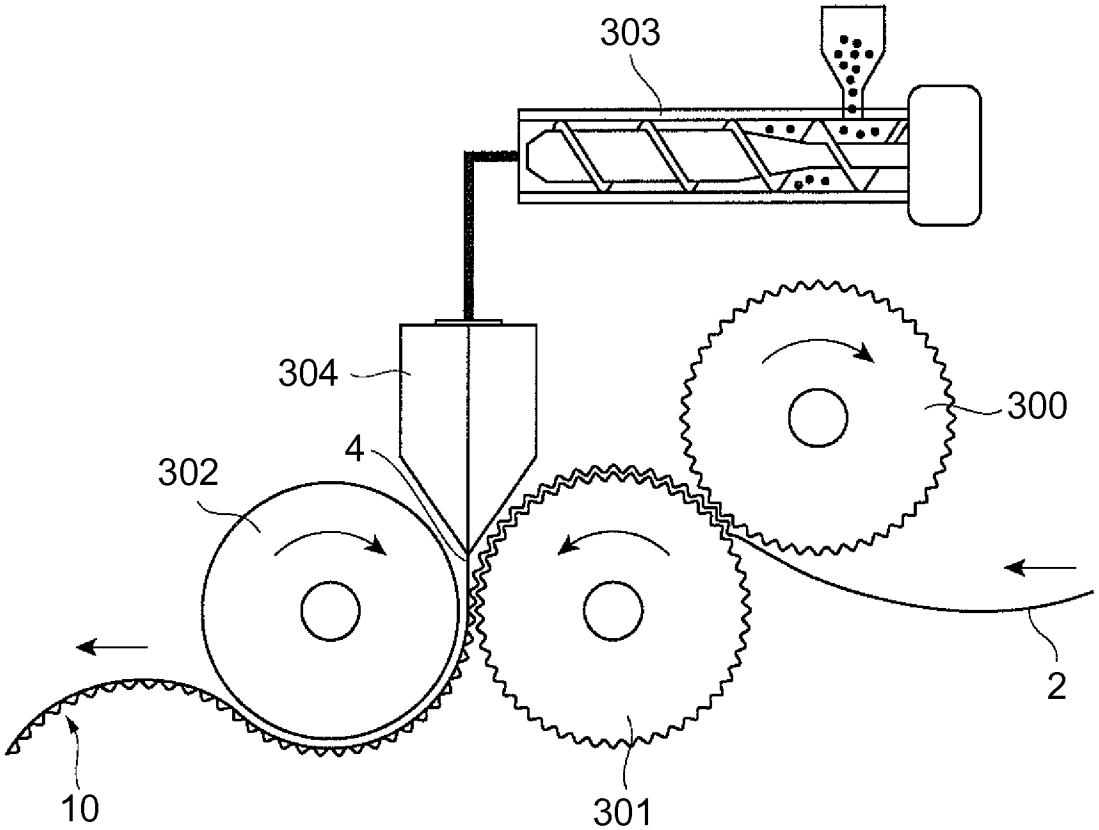
FIG. 4 illustrates an exemplary method for making the stretchable laminate illustrated in FIG. 2.

The stretchable laminate 10 including the nonwoven 2 and elastomer strands 4 may be obtained by a method such as that described below, for example. FIG. 4 illustrates an exemplary method for producing the two-layer structure stretchable laminate illustrated in FIG. 2. Firstly, a sheet-like nonwoven 2 produced by the melt-blown method is sent, as indicated by arrow in FIG. 4, between forming rolls 300 and 301 having a corrugated pattern of concavities and protuberances, and a corrugated nonwoven 2 is formed that has valley portions 2*a* and ridge portions 2*b*. By changing the utilized forming rolls 300 and 301, it is possible to change the shape of the nonwoven 2 (i.e. shapes of the valley portion 2*a* and ridge portion 2*b*) to a desired shape, and it is possible to change the count (pitch) of ridge portions 2*b* per 1 cm in the cross direction to a desired count (pitch). The nonwoven 2 formed to have a corrugated pattern is sent between the forming roll 301 and chill roll 302 by rotation of the forming roll 301.

On the other hand, the thermoplastic elastomer is plasticized in the extruder 303, and the plasticized thermoplastic elastomer is fed to the T die 304 by extrusion from the extruder 303. Due to passage of the thermoplastic elastomer through the T die 304, the elastomer is formed into multiple elastomer strands 4. The elastomer strands 4 extruded in the molten state from the T die 304 are fed between the forming roll 301 and the chill roll 302. Thereafter, the corrugated nonwoven 2 and the multiple elastomer strands 4 are bonded together between the forming roll 301 and the chill roll 302 so as to produce the two-layer structure stretchable laminate 10.

An adhesive agent may be used for bonding together the nonwoven 2 and the elastomer strands 4, and hot melt adhesion may be used. When hot melt adhesion is used, it is possible to increase the strength of bonding by using the aforementioned material having hot melt adhesion as the material of the surface of the fibers constituting the elastomer strands 4 or the nonwoven 2.

Furthermore, for producing the three-layer structure stretchable laminate 11, the three-layer structure stretchable laminate 11 may be obtained by further feeding a nonwoven 6 between the forming roll 301 and the chill roll 302.

The nonwoven according to an embodiment of the present invention and the stretchable laminate according to another embodiment of the present invention are suitable for use in sanitary articles such as diapers or the like and in domestic products or the like.

EXAMPLES

The nonwoven, the two-layer structure stretchable laminate, and the three-layer structure stretchable laminate of the present invention will be explained in a more concrete manner below based on working examples. However, the present invention is not limited by the below working examples.

Working Example 1

A nonwoven was produced by the below described method.

Specifically, fibers having a core-in-sheath structure were produced by the below described melt-blown method. These fibers having the core-in-sheath structure include a thermoplastic elastomer (core part) and a polyolefin (sheath part) composed of the components listed below in Table 2.

A first extruder (220° C.) was used to melt a linear low density polyethylene (LLDPE) resin (DNDA-1082, marketed by Dow Chemical Company) having a melt flow rate (MFR) of 160 g/10 minutes, and the melted linear low density polyethylene was fed to a feed block-splitter assembly heated to about 220° C. A second extruder (260° C.) was used to melt a thermoplastic polyurethane elastomer (TPU) resin (ET 870, marketed by BASF), and the molten thermoplastic polyurethane elastomer was fed to the feed block-splitter assembly. The flows of the supplied molten resins were separated into a plurality of respective flows by the splitter part, and these molten resin flows were maintained in a non-contacting state up until immediately prior to the outlet port of the feed block-splitter assembly. The molten resin flows were integrated at the outlet port to form a three-layered molten resin flow composed of polyolefin/thermoplastic elastomer/polyolefin. By use of gear pumps for adjusting flow rates of the molten resins at this time, molten resins were fed so as to result in a weight % ratio of polyolefin (LLDPE):thermoplastic elastomer (TPU) of 20:80. The melt-blown die (220° C.) had oval-shaped (length:diameter ratio=5:1) smooth-surfaced orifices (10 orifices/cm), and the polymer processing velocity per die width was maintained at 0.14 kg/hr/cm (0.8 lb/hr/inch).

Heated air (about 230° C.) was fed at high velocity toward the extruded molten resin, and a pressure was maintained that was suitable for forming a uniform nonwoven having a gap width of 0.076 cm. During this operation, the melt flow of three layers discharged from the BMF die formed fibers having the core-in-sheath structure and equipped with a core part and a sheath part by fusion so that the low MFR polyolefin layer enveloped the thermoplastic elastomer. These fibers having the core-in-sheath structure were blown against the drum rotating at a sufficiently slow rotation rate below the velocity of the flow of the fibers so that a web was formed by accumulation of the fibers on the drum surface to obtain the nonwoven. The obtained nonwoven was wound on the drum. The distance between the BMF die and the drum was 15.24 cm (6 inches). The obtained nonwoven included fibers having a core-in-sheath structure provided with a core part and a sheath part, the average diameter of the fibers was 15 μm, and the area ratio of the core part to sheath part in cross section was 80:20. The basis weight of the nonwoven was 15 g/m$^2$.

Working Examples 2 to 5 and Comparative Examples 1 to 3

Using the components listed in Table 2 and Table 3, nonwovens were produced in the same manner as in Working Example 1. The average diameter of the obtained fiber, cross sectional area ratios of the core part to sheath part, and basis weight of the nonwoven are indicated in Tables 2 and 3.

Measurement of Shear Viscosity

The shear viscosity was measured by the below described method for the polymers composing the core parts and sheath parts listed in Tables 2 and 3.

The polymer was heat pressed to a thickness of about 1 mm using a hot plate. The temperature during heat pressing was determined by the type and melt temperature of the polymer, and this temperature was set to the melt temperature of the polymer (in the range of 150 to 240° C.). Furthermore, a dryer was used to dry the TPU for several hours at 70° C. prior to heat pressing. The heat pressed polymer after heat pressing was trimmed to a diameter of 25 mm to provide the test piece. This test piece was used for measuring shear viscosity using a DMA measurement apparatus (i.e. viscoelasticity measurement apparatus (ARES) manufactured by TA Instruments Japan Inc.). Measurement of shear viscosity was performed at a shear rate of 150 s$^{-1}$ and a temperature of 240° C. (temperature selected in the 220° C. to 260° C. temperature interval) based on the cone and plate viscosity measurement method.

For the compositions listed in Tables 2 and 3, at a shear rate of 150 s$^{-1}$ and temperature of 240° C., it was confirmed that shear viscosity of the sheath part was lower than shear viscosity of the core part. These values are shown in the below listed Table 1.

TABLE 1

| | | | Shear viscosity (Pa · s) |
|---|---|---|---|
| Core part | TPU | BASF ET870 | 90 |
| | | Huntsman PS440 | 14.1 |
| | | BASF C65A | 24.8 |
| | | SEBS (Kraton G1657) 80% | 20 |
| | | LLDPE (Dow Chemical DNDB-1077) 20% | |
| Sheath part | LLDPE | Dow Chemical DNDA-1082 | 3.5 |
| | | Dow Chemical DNDB-1077 | 7.4 |
| | | ExxonMobil 6201XR | 8.2 |
| | PP | Total 3860X | 8.2 |
| | | Basel MF 650W | 2.1 |

Working Example 6

The nonwovens (flat and corrugated shape) used as the stretchable laminate were produced by the below listed method.

The (flat) nonwoven comprising fibers having the core-in-sheath structure composed of the components listed in the below Table 4 was produced in the same manner as that of Working Example 1, and this (flat) nonwoven was used. The area ratio of the core part to the sheath part in the fiber cross section was 80:20. The fiber diameter of the nonwoven was 12 μm, and the basis weight was 20.5 g/m$^2$.

The (corrugated) nonwoven was formed using the nonwoven obtained in the aforementioned manner. This nonwoven, a device such as that shown in FIG. 4, and a forming roll were used to form a corrugated pattern having a ridge portion 2*b* width of 1 mm, a height difference of 1 mm (from the bottom tip of the valley portion 2*a* to the top tip of the ridge portion 2*b*), and 3.93 cm$^{-1}$ ridge portions 2*b* (pitch) per 1 cm in the cross direction of the nonwoven.

The elastomer strands used in the stretchable laminate were produced by the below described method. A film manufacturing device composed of a T die single-screw melt extruder and chill roll (model No. VS30, manufactured by Tanabe Plastics Machinery Co., Ltd.) was used to manufacture elastomer strands having a circular cross section of 0.5 mm diameter and composed of a core part formed from styrene-isoprene-styrene block copolymer (Quintac 3390, marketed by Zeon Corporation) covered by a sheath part formed from linear low density polyethylene (6201 XR, marketed by ExxonMobil Corporation) by using the same method as that of Working Example 1. The area ratio of the core part to the sheath part in the cross section was 99:1. The basis weight of the elastomer strand was 20 g/m$^2$.

The two-layer structure stretchable laminate was produced by the below described method. Bonding of the (corrugated) nonwovens to the elastomer strands was performed at a hot melt adhesion temperature of greater than or equal to 200° C. and less than or equal to 300° C. to obtain the two-layer structure stretchable laminate. The valley portions 2*a* of the (corrugated) nonwoven were bonded to the elastomer strands, and the ridge portions 2*b* of the (corrugated) nonwoven were separated from the elastomer strands.

The three-layer structure stretchable laminate was produced by the below described method. At the time of production of the two-layer structure stretchable laminate obtained in the aforementioned manner, a (flat) nonwoven was fed so as to sandwich the elastomer strands between the (corrugated) nonwoven and the (flat) nonwoven, and the elastomer strands and nonwovens were bonded together. Bonding of the nonwovens to the elastomer strands was performed at a hot melt adhesion temperature of greater than or equal to 200° C. and less than or equal to 300° C. to obtain the three-layer structure stretchable laminate. The elastomer strands were bonded to the valley portions 2*a* of the (corrugated) nonwoven, and the ridge portions 2*b* were separated from the elastomer strands. On the other hand, the elastomer strands were secured to the (flat) nonwoven along the entire length of the strands.

Working Examples 7 to 15 and Comparative Examples 4 to 8

The components listed in the below Tables 4 to 6 were used, and the nonwovens, two-layer structure stretchable laminates, and three-layer structure stretchable laminates of the working examples and comparative examples were produced by the same methods as described above.

Stress-Strain Testing

The obtained nonwovens and stretchable laminates were each formed into rectangular pieces that were 25 mm wide and 80 mm long. The stress-strain testing was performed in both MD and CD. During stress-strain testing, the stretchable laminate was grasped using a chuck separation of 25 mm, the stretchable laminate was stretched up to 100% elongation at a tensile speed of 300 mm/minute, followed by recovery. The cycle was repeated twice.

Figure 5:
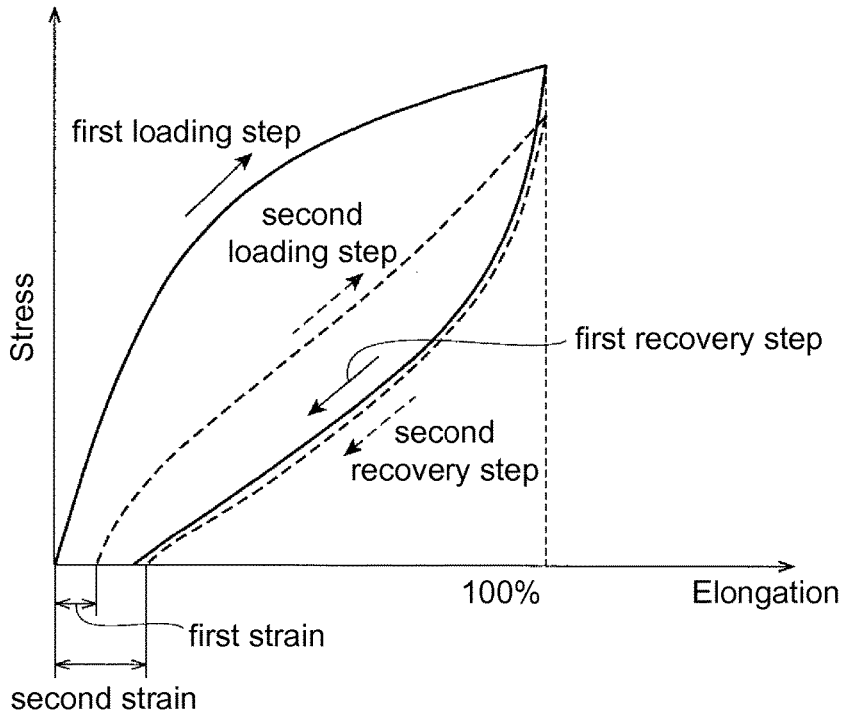
FIG. 5 shows the relationship between stress and elongation occurring in a stretchable laminate undergoing strain testing.

FIG. 5 is a chart showing the relationship between stress and elongation occurring in the stretchable laminate during strain testing. As shown in FIG. 5, a first cycle including a first loading step and a first recovery step, and then a second cycle including a second loading step and a second recovery step were performed. Measurement was performed of the stress at the time of the first elongation (50% and 100% load), stress at the time of the second recovery (50% load), and the strain after the second cycle (second strain). The results are shown in Tables 2 to 6.

Stiffness Testing

Stiffness testing was performed on the obtained nonwoven and stretchable laminate according to the cantilever method. Pieces measuring 15 mm×150 mm were placed on the upper base surface of a trapezoidal shaped tester having a 45° inclined face at the front. At this time, one end portion in the lengthwise direction of the test piece was adjusted to overlap the front end portion of the upper base surface of the test apparatus, and the position (initial position) of the opposite end portion in the lengthwise direction of the test piece was recorded. Thereafter, the test piece was slid outwardly from the front end portion of the upper base surface, and the sliding distance of the test piece was determined when there was contact by the test piece with the inclined face of the test apparatus. This distance was determined by measuring the distance (mm) of movement of the other end portion of the test piece from the initial position on the upper base surface of the test apparatus. The stiffness of the test piece was evaluated based on the distance of sliding of the test piece. The results are shown in Tables 2 to 6.

Surface Softness Testing: Skin Feel

The feel against the skin of the obtained nonwoven and stretchable laminate was observed by the sensory test method, and evaluation was performed as to whether the sample had suitable skin feel based on the below listed criteria.

A test piece that was at least 150 mm wide and at least 250 mm long was produced and placed on a table (in the case of the stretchable laminate, the nonwoven surface was placed upward). Next, the test piece was arranged so as to be positioned in front of the test person. The back of the right hand was placed against the test piece, and the hand was slid from the front to the right. This action was repeated 3 times. At this time, the test person applied no force pressing down on the table. Feel of the test piece against the skin was evaluated in 5 stages. A test piece having excellent skin feel was evaluated as "5" (i.e. quite excellent smoothness, very smooth motion, and extremely clean feel). A test piece of inferior skin feel was evaluated as 1. The results are shown in Tables 2 to 6.

TABLE 2

| | | Working Example 1 | Working Example 2 | Working Example 3 | Working Example 4 | Working Example 5 |
|---|---|---|---|---|---|---|
| Nonwoven material | core part | TPU (BASF ET870) | TPU (BASF ET870) | TPU (Huntsman PS440) | SEBS (Kraton G1657) 80% LLDPE (Dow Chemical DNDB-1077) 20% | TPU (BASF C65A) |
| | sheath part | LLDPE (Dow Chemical DNDA-1082) | LLDPE (Dow Chemical DNDB-1077) | PP (Basel MF 650W) | LLDPE (Dow Chemical DNDB-1077) | LLDPE (Dow Chemical DNDA-1082) |
| | sheath part melt flow rate (g/10 min) 190° C., 2.16 kg load | 160 | 100 | 350 | 100 | 160 |
| | area ratio (core part/sheath part) | 80/20 | 80/20 | 80/20 | 70/30 | 80/20 |
| | fiber diameter (μm) | 15 | 15 | 25 | 21 | 22.5 |
| | basis weight ($g/m^2$) | 12 | 15 | 30 | 30 | 30 |
| MD direction stress | 1st elongation, 50% load (N/25 mm) | 0.63 | 0.74 | 1.33 | 1.24 | 0.61 |

TABLE 2-continued

| | | Working Example 1 | Working Example 2 | Working Example 3 | Working Example 4 | Working Example 5 |
|---|---|---|---|---|---|---|
| | 1st elongation, 100% load (N/25 mm) | 0.79 | 0.91 | 1.21 | 1.41 | 0.82 |
| | 2nd recovery, 50% load (N/25 mm) | 0.08 | 0.04 | 0 | 0.1 | 0.2 |
| | strain after 2nd elongation | 44.2 | 48.2 | 56.2 | 43.8 | 35.8 |
| CD direction stress | 1st elongation, 50% load (N/25 mm) | 0.55 | 0.63 | 1.11 | 1.09 | 0.54 |
| | 1st elongation, 100% load (N/25 mm) | 0.58 | 1.58 | 1.46 | 1.29 | 0.75 |
| | 2nd recovery, 50% load (N/25 mm) | 0.03 | 0.01 | 0 | 0.03 | 0.15 |
| | strain after 2nd elongation | 47.3 | 48.3 | 54.4 | 49.2 | 39.2 |
| | Stiffness (mm) | 24 | 33 | 44 | 31 | 19 |
| | Skin feel | 5 | 4 | 2 | 4 | 5 |

TABLE 3

| | | Comparative Example 1 | Comparative Example 2 | Comparative Example 3 |
|---|---|---|---|---|
| Nonwoven material | core part | TPU (Huntsman PS440) | TPU (Huntsman PS440) | TPU (Huntsman PS440) |
| | sheath part | PP (Total 3860X) | PP (Total 3860X) | LLDPE (ExxonMobil 6201XR) |
| | sheath part melt flow rate (g/10 min) 190° C., 2.16 kg load | 60 | 60 | 50 |
| | area ratio (core part/sheath part) | 90/10 | 80/20 | 80/20 |
| | fiber diameter (μm) | 15 | 15 | 15 |
| | basis weight (g/m$^2$) | 30 | 30 | 30 |
| MD direction stress | 1st elongation, 50% load (N/25 mm) | 2.44 | 2.21 | 2.09 |
| | 1st elongation, 100% load (N/25 mm) | 2.84 | 2.64 | 2.46 |
| | 2nd recovery, 50% load (N/25 mm) | 0.1 | 0 | 0.28 |
| | strain after 2nd elongation | 46.9 | 53.4 | 32.8 |
| CD direction stress | 1st elongation, 50% load (N/25 mm) | 2.19 | 1.98 | 1.82 |
| | 1st elongation, 100% load (N/25 mm) | 2.58 | 2.41 | 2.27 |
| | 2nd recovery, 50% load (N/25 mm) | 0 | 0 | 0.17 |
| | strain after 2nd elongation | 53.8 | 52.9 | 39.1 |
| | Stiffness (mm) | 48 | 45 | 38 |
| | Skin feel | 1 | 2 | 3 |

TABLE 4

| | | Working Example 6 | Working Example 7 | Working Example 8 | Working Example 9 | Working Example 10 | Working Example 11 |
|---|---|---|---|---|---|---|---|
| Nonwoven material (corrugated) | core part | Low Modulus TPU (BASF ET870) | Low Modulus TPU (BASF ET870) | Low Modulus TPU (BASF ET870) | Low Modulus TPU (BASF ET870) | Low Modulus TPU (BASF C65A) | TPU (Huntsman PS440) |
| | sheath part | High MFR LLDPE (Dow Chemical DNDA-1082) | High MFR LLDPE (Dow Chemical DNDA-1082) | High MFR LLDPE (Dow Chemical DNDA-1082) | High MFR LLDPE (Dow Chemical DNDA-1082) | High MFR LLDPE (Dow Chemical DNDA-1082) | PP (Basel MF 650W) |
| | sheath part melt flow rate (g/10 min) 190° C., 2.16 kg load | 160 | 160 | 160 | 160 | 160 | 350 |
| | area ratio (core part/sheath part) | 80/20 | 80/20 | 80/20 | 80/20 | 80/20 | 80/20 |
| | fiber diameter (μm) | 12 | 12 | 12 | 12 | 22.5 | 25 |
| | basis weight (g/m$^2$) | 20.5 | 20.5 | 20.5 | 20.5 | 30 | 30 |
| Elastomer strand | core part | SIS (Zeon Quintac 3390) | SIS (Zeon Quintac 3390) | SIS (Zeon Quintac 3390) | SIS (Zeon Quintac 3390) | SIS (Zeon Quintac 3390) | SIS (Zeon Quintac 3390) |
| | sheath part | LLDPE (ExxonMobil 6201XR) | LLDPE (ExxonMobil 6201XR) | LLDPE (ExxonMobil 6201XR) | LLDPE (ExxonMobil 6201XR) | LLDPE (ExxonMobil 6201XR) | LLDPE (ExxonMobil 6201XR) |
| | area ratio (core part/sheath part) | 99/1 | 99/1 | 99/1 | 99/1 | 99/1 | 99/1 |
| | basis weight (g/m$^2$) | 20 | 15 | 20 | 15 | 20 | 15 |
| Nonwoven material (flat) | core part | Low Modulus TPU (BASF ET870) | Low Modulus TPU (BASF ET870) | — | — | — | TPU (Huntsman PS440) |
| | sheath part | High MFR LLDPE (Dow Chemical DNDA-1082) | High MFR LLDPE (Dow Chemical DNDA-1082) | — | — | — | PP (Basel MF 650W) |
| | area ratio (core part/sheath part) | 80/20 | 80/20 | — | — | — | 80/20 |
| | fiber diameter (μm) | 12 | 12 | — | — | — | 25 |
| | basis weight (g/m$^2$) | 20.5 | 20.5 | — | — | — | 30 |
| MD direction stress | 1st elongation, 50% load (N/25 mm) | 1.28 | 0.85 | 0.8 | 0.46 | 0.45 | 3.46 |
| | 1st elongation, 100% load (N/25 mm) | 1.53 | 1.22 | 1.3 | 0.85 | 0.96 | 3.75 |
| | 2nd recovery, 50% load (N/25 mm) | 0.59 | 0.48 | 0.67 | 0.38 | 0.55 | 0.34 |
| | strain after 2nd elongation | 16 | 13 | 12 | 18 | 12 | 34 |
| CD direction stress | 1st elongation, 50% load (N/25 mm) | 0.22 | 0.24 | 0.12 | 0.14 | 0.23 | 2.31 |
| | 1st elongation, 100% load (N/25 mm) | 0.36 | 0.39 | 0.22 | 0.23 | 0.33 | 2.58 |
| | 2nd recovery, 50% load (N/25 mm) | 0.07 | 0.04 | 0.04 | 0.02 | 0.06 | 0 |
| | strain after 2nd elongation | 42 | 45 | 43 | 45 | 45 | 55 |
| | Stiffness (mm) | 26 | 22 | 18 | 16 | 19 | 47 |
| | Skin feel | 5 | 5 | 5 | 5 | 5 | 2 |

TABLE 5

| | | Working Example 12 | Working Example 13 | Working Example 14 | Working Example 15 |
|---|---|---|---|---|---|
| Nonwoven material (corrugated) | core part | SEBS (Kraton G1657) 80% LLDPE (Dow Chemical DNDB-1077) 20% | SEBS (Kraton G1657) 80% LLDPE (Dow Chemical DNDB-1077) 20% | SEBS (Kraton G1657) 80% LLDPE (Dow Chemical DNDB-1077) 20% | SEBS (Kraton G1657) 80% LLDPE (Dow Chemical DNDB-1077) 20% |

TABLE 5-continued

| | | Working Example 12 | Working Example 13 | Working Example 14 | Working Example 15 |
|---|---|---|---|---|---|
| | sheath part | High MFR LLDPE (Dow Chemical DNDB-1077) | High MFR LLDPE (Dow Chemical DNDB-1077) | High MFR LLDPE (Dow Chemical DNDB-1077) | High MFR LLDPE (Dow Chemical DNDB-1077) |
| | sheath part melt flow rate (g/10 min) 190° C., 2.16 kg load | 100 | 100 | 100 | 100 |
| | area ratio (core part/sheath part) | 70/30 | 70/30 | 70/30 | 70/30 |
| | fiber diameter (μm) | 20 | 20 | 20 | 20 |
| | basis weight ($g/m^2$) | 21.5 | 21.5 | 21.5 | 21.5 |
| Elastomer strand | core part | SIS (Zeon Quintac 3390) | SIS (Zeon Quintac 3390) | SIS (Zeon Quintac 3390) | SIS (Zeon Quintac 3390) |
| | sheath part | LLDPE (ExxonMobil 6201XR) | LLDPE (ExxonMobil 6201XR) | LLDPE (ExxonMobil 6201XR) | LLDPE (ExxonMobil 6201XR) |
| | area ratio (core part/sheath part) | 99/1 | 99/1 | 99/1 | 99/1 |
| | basis weight ($g/m^2$) | 20 | 15 | 20 | 15 |
| Nonwoven material (flat) | core part | — | — | SEBS (Kraton G1657) 80% LLDPE (Dow Chemical DNDB-1077) 20% | SEBS (Kraton G1657) 80% LLDPE (Dow Chemical DNDB-1077) 20% |
| | sheath part | — | — | High MFR LLDPE (Dow Chemical DNDB-1077) | High MFR LLDPE (Dow Chemical DNDB-1077) |
| | area ratio (core part/sheath part) | — | — | 70/30 | 70/30 |
| | fiber diameter (μm) | — | — | 20 | 20 |
| | basis weight ($g/m^2$) | — | — | 13.6 | 13.6 |
| MD direction stress | 1st elongation, 50% load (N/25 mm) | 1.19 | 0.95 | 1.98 | 1.5 |
| | 1st elongation, 100% load (N/25 mm) | 1.87 | 1.5 | 2.03 | 1.86 |
| | 2nd recovery, 50% load (N/25 mm) | 0.65 | 0.53 | 0.65 | 0.4 |
| | strain after 2nd elongation | 14 | 11.6 | 11 | 18.3 |
| CD direction stress | 1st elongation, 50% load (N/25 mm) | 0.28 | 0.29 | 0.48 | 0.54 |
| | 1st elongation, 100% load (N/25 mm) | 0.31 | 0.31 | 0.68 | 0.72 |

TABLE 5-continued

| | | Working Example 12 | Working Example 13 | Working Example 14 | Working Example 15 |
|---|---|---|---|---|---|
| | 2nd recovery, 50% load (N/25 mm) | 0.01 | 0.02 | 0.06 | 0.07 |
| | strain after 2nd elongation | 47 | 41.9 | 44 | 42 |
| Stiffness (mm) | | 28 | 30 | 28 | 30 |
| Skin feel | | 4 | 4 | 4 | 4 |

TABLE 6

| | | Comparative Example 5 | Comparative Example 6 | Comparative Example 7 | Comparative Example 8 |
|---|---|---|---|---|---|
| Nonwoven material (corrugated) | core part | TPU (Huntsman PS440) | TPU (Huntsman PS440) | TPU (Huntsman PS440) | TPU (Huntsman PS440) |
| | sheath part | PP (Total 3860X) | PP (Total 3860X) | LLDPE (ExxonMobil 6201XR) | LLDPE (ExxonMobil 6201XR) |
| | sheath part melt flow rate (g/10 min) 190° C., 2.16 kg load | 60 | 60 | 50 | 50 |
| | area ratio (core part/sheath part) | 90/10 | 80/20 | 80/20 | 80/20 |
| | fiber diameter (μm) | 10 | 10 | 20 | 18 |
| | basis weight (g/m$^2$) | 30 | 30 | 16 | 30 |
| Elastomer strand | core part | SIS (Zeon Quintac 3390) | SIS (Zeon Quintac 3390) | SIS (Zeon Quintac 3390) | SIS (Zeon Quintac 3390) |
| | sheath part | PP (Total 3860X) | PP (Total 3860X)) | LLDPE (ExxonMobil 6201XR) | LLDPE (ExxonMobil 6201XR) |
| | area ratio (core part/sheath part) | 98/2 | 98/2 | 99/1 | 99/1 |
| | basis weight (g/m$^2$) | 50 | 80 | 20 | 20 |
| Nonwoven material (flat) | core part | TPU (Huntsman PS440) | TPU (Huntsman PS440) | TPU (Huntsman PS440) | — |
| | sheath part | PP (Total 3860X) | PP (Total 3860X) | LLDPE (ExxonMobil 6201XR) | — |
| | area ratio (core part/sheath part) | 90/10 | 80/20 | 80/20 | — |
| | fiber diameter (μm) | 10 | 10 | 14 | — |
| | basis weight (g/m$^2$) | 15 | 15 | 14 | — |
| MD direction stress | 1st elongation, 50% load (N/25 mm) | 5.51 | 5.92 | 3.13 | 1.74 |
| | 1st elongation, 100% load (N/25 mm) | 7.21 | 7.72 | 4.04 | 3.6 |
| | 2nd recovery, 50% load (N/25 mm) | 0.64 | 0.99 | 0.64 | 0.67 |

TABLE 6-continued

| | | Comparative Example 5 | Comparative Example 6 | Comparative Example 7 | Comparative Example 8 |
|---|---|---|---|---|---|
| | strain after 2nd elongation | 9.8 | 10.2 | 13.1 | 12.5 |
| CD direction stress | 1st elongation, 50% load (N/25 mm) | 1.62 | 1.75 | 1 | 1.11 |
| | 1st elongation, 100% load (N/25 mm) | 1.71 | 1.81 | 1.33 | 1.54 |
| | 2nd recovery, 50% load (N/25 mm) | 0 | 0 | 0.09 | 0.04 |
| | strain after 2nd elongation | 59.1 | 66 | 37.1 | 44.9 |
| Stiffness (mm) | | 61 | 74 | 51 | 43 |
| Skin feel | | 1 | 1 | 3 | 3 |

In Tables 2 to 6, the abbreviations for the components of the core part and sheath part refer to the below listed components.

TPU: urethane-based thermoplastic elastomer (produced by BASF, ET 870 and C65A; produced by Huntsman Corporation, PS 440)

SEBS: Styrene-ethylene-butylene-styrene block copolymer (produced by Kraton Polymers, G 1657)

LLDPE: Linear low density polyethylene (produced by Dow Chemical Company, DNDA-1082 and DNDB-1077; produced by ExxonMobil Corporation, 6201XR)

SIS: Styrene-isoprene-styrene block copolymer (produced by Zeon Corporation, QUINTAC 3390)

PP: Polypropylene (produced by LyondellBasell, MF 650W; produced by Total Petrochemicals, 3860X)

What is claimed is:

1. A nonwoven comprising fibers having a core-in-sheath structure comprising a core part and a sheath part;

the core part comprising a thermoplastic elastomer; and the sheath part comprising a polyolefin of a lower shear viscosity than the thermoplastic elastomer at a specific shear rate selected in a range from 100 $s^{-1}$ to 200 $s^{-1}$ at a specific temperature selected in a temperature range of greater than or equal to 220° C. to less than or equal to 260° C., and a melt flow rate of the polyolefin being greater than or equal to 100 g/10 minutes.

2. The nonwoven according to claim 1, wherein the thermoplastic elastomer is a thermoplastic polyurethane.

3. The nonwoven according to claim 2, wherein the polyolefin is a linear low density polyethylene.

4. The nonwoven according to claim 2, wherein a stress at 50% elongation is less than or equal to 1.3 N/25 mm.

5. The nonwoven according to claim 2, wherein one surface of the nonwoven is a smooth surface having a lower average indentation depth value as compared to another surface of the nonwoven.

6. A stretchable laminate comprising:

the nonwoven according to claim 2; and a plurality of elastomer strands disposed with distances therebetween;

the elastomer strands comprising regions in which the elastomer strands are joined to the nonwoven, and regions in which the elastomer strands are separated from the nonwoven.

7. The nonwoven according to claim 1, wherein the polyolefin is a linear low density polyethylene.

8. The nonwoven according to claim 7, wherein a stress at 50% elongation is less than or equal to 1.3 N/25 mm.

9. The nonwoven according to claim 7, wherein one surface of the nonwoven is a smooth surface having a lower average indentation depth value as compared to another surface of the nonwoven.

10. A stretchable laminate comprising:

the nonwoven according to claim 7; and a plurality of elastomer strands disposed with distances therebetween;

the elastomer strands comprising regions in which the elastomer strands are joined to the nonwoven, and regions in which the elastomer strands are separated from the nonwoven.

11. The nonwoven according to claim 1, wherein a stress at 50% elongation is less than or equal to 1.3 N/25 mm.

12. The nonwoven according to claim 11, wherein one surface of the nonwoven is a smooth surface having a lower average indentation depth value as compared to another surface of the nonwoven.

13. A stretchable laminate comprising:

the nonwoven according to claim 11; and a plurality of elastomer strands disposed with distances therebetween;

the elastomer strands comprising regions in which the elastomer strands are joined to the nonwoven, and regions in which the elastomer strands are separated from the nonwoven.

14. The nonwoven according to claim 1, wherein one surface of the nonwoven is a smooth surface having a lower average indentation depth value as compared to another surface of the nonwoven.

15. A stretchable laminate comprising:

the nonwoven according to claim 14; and a plurality of elastomer strands disposed with distances therebetween;

the elastomer strands comprising regions in which the elastomer strands are joined to the nonwoven, and regions in which the elastomer strands are separated from the nonwoven.

16. A stretchable laminate comprising:

the nonwoven according to claim 1; and a plurality of elastomer strands disposed with distances therebetween;

the elastomer strands comprising regions in which the elastomer strands are joined to the nonwoven, and regions in which the elastomer strands are separated from the nonwoven.

* * * * *